US007334505B1

(12) United States Patent
Jenkins

(10) Patent No.: US 7,334,505 B1
(45) Date of Patent: Feb. 26, 2008

(54) HANGING CLAMP WRENCH

(76) Inventor: Ronald A. Jenkins, 3184 El Chico Ct., Las Vegas, NV (US) 89120

( * ) Notice: Subject to any disclaimer, the term of this patent is extended or adjusted under 35 U.S.C. 154(b) by 0 days.

(21) Appl. No.: 11/163,386

(22) Filed: Oct. 17, 2005

Related U.S. Application Data

(60) Provisional application No. 60/619,479, filed on Oct. 15, 2004.

(51) Int. Cl.
*B25B 13/06* (2006.01)

(52) U.S. Cl. ..... 81/121.1; 81/124.2

(58) Field of Classification Search ..... 81/121.1, 81/124.2
See application file for complete search history.

(56) References Cited

U.S. PATENT DOCUMENTS 1,188,305 A * 6/1916 Noerteman ..... 411/409
2,465,048 A * 3/1949 Wentling ..... 81/121.1
3,151,512 A * 10/1964 Charczenko ..... 81/176.2
5,287,775 A * 2/1994 Moore ..... 81/121.1
5,865,582 A 2/1999 Ellis
6,314,841 B1 * 11/2001 Burk et al. ..... 81/125.1

* cited by examiner

*Primary Examiner*—Joseph J. Hail, III
*Assistant Examiner*—Shantese L. McDonald
(74) *Attorney, Agent, or Firm*—Kenehan & Lambertsen, Ltd; John C. Lambertsen

(57) ABSTRACT

A hand tool consisting of an outer grip having an elongate inner housing formed therein engages with wing knobs used to tighten and loosen hanging file clamps. The outer grip is provided with a plurality of planar elongate gripping surfaces to enable a user to apply greater force to the wing knobs, which are frequently over-tightened by previous users. A pair of lattitudinally extending inner frame members are used to form two receiving areas for the wing knobs, a central elongate recess receives wing knobs of smaller diameter. By vertically recessing the upper surfaces of the inner frame members, wing knobs of greater diameter are received within the entire elongate inner housing.

2 Claims, 1 Drawing Sheet

Figure 1A
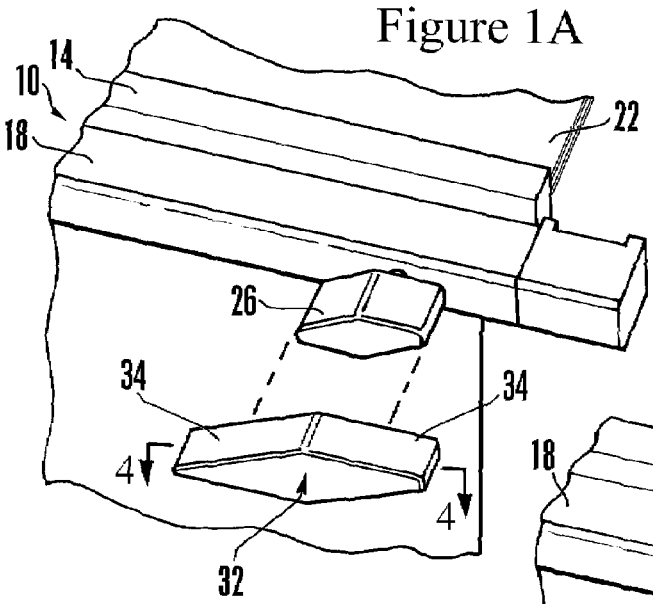
Figure 1B
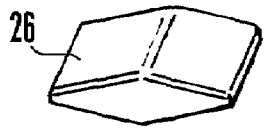
Figure 2
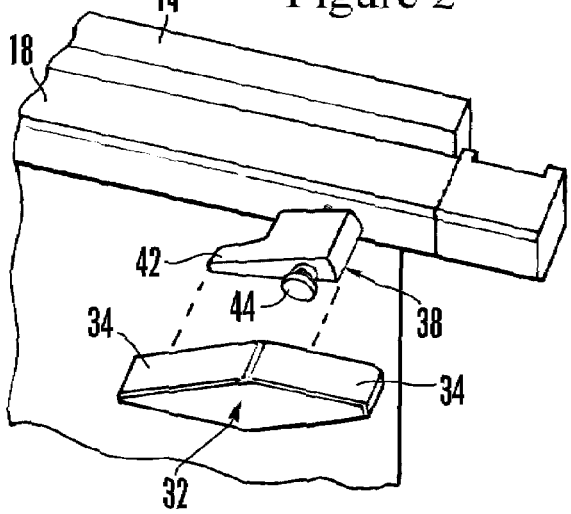
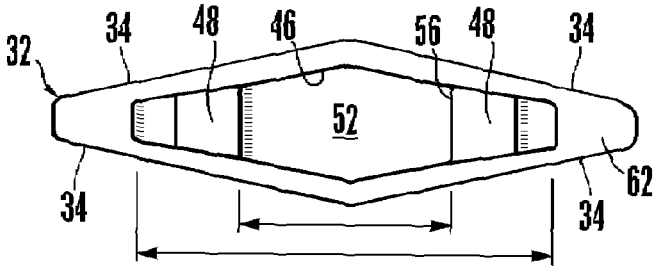
Figure 3
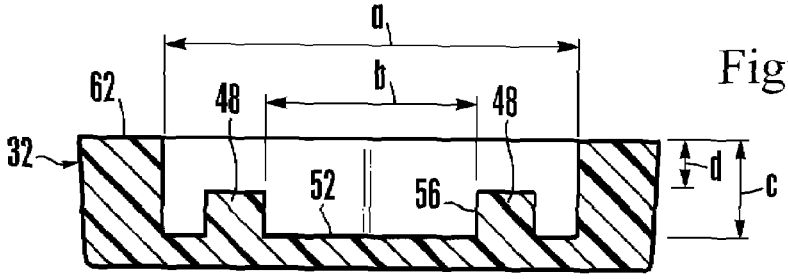
Figure 4

HANGING CLAMP WRENCH

CROSS-REFERENCE TO RELATED APPLICATION

This application claims the benefit of U.S. Provisional Application Ser. No. 60/619,479, filed Oct. 15, 2004.

FIELD OF THE INVENTION

The present invention relates to mechanical helpers and, more particularly, to such helpers as are useful for the tightening and loosening of mechanisms for attachment. More specifically, the present invention relates to a hand tool that is received by a fastener handle enabling the user to apply greater force thereto when either tightening or loosening the fastener.

DESCRIPTION OF THE PRIOR ART

Blueprints and other collections of over-sized paper are frequently organized by placement in hanging clamps and in vertical plan files. Both use screw tightening mechanisms to retain the pages of paper within the clamp or file. A handle is provided for operating the screw mechanism, and not infrequently, these are difficult to turn due to over tightening by the previous user.

Many times the prior user will tighten the mechanism by using wrenches and pliers, forcing the next user to make use of similar tools to release the mechanism to add or remove papers. In an office context, the requirement to use such tools results in lost time as they are normally not readily available to all who require access to the files.

SUMMARY OF THE INVENTION

It is an object of the present invention to provide an outer grip that is received by and engages with the various screw-tightening handles, the outer grip providing a user with greater leverage towards operating the screw mechanism.

It is a further object of the present invention to provide a handgrip that is easily carried and stored upon a person or in locations convenient to its use adjacent hanging clamps and vertical plan files.

Additional aspects of the present invention will become apparent from the following description, taken in conjunction with the accompanying drawings.

BRIEF DESCRIPTION OF THE DRAWINGS

FIG. 1A is a partial perspective view showing an outer grip as received by and engaging with a hanging clamp knob.

FIG. 1B is a perspective view showing an outer surface of a hanging clamp knob.

FIG. 2 is a partial perspective view, similar to FIG. 1A, showing an outer grip as received by and engaging with a hanging clamp knob of an alternative design.

FIG. 3 is a bottom plan view showing an internal cavity of an outer grip.

FIG. 4 is a cross-sectional view taken along line 4-4 of FIG. 1A.

DETAILED DESCRIPTION OF THE PREFERRED EMBODIMENTS

Reference is now made to the drawings wherein like numerals refer to like parts throughout. In FIG. 1, a vertical clamp file 10 utilizes a document binder 14 constrained by a clamp 18 to hold a plurality of documents 22, such as orthographic maps, detailed land use documents, and blueprints.

The clamp 18 applies pressure to the document binder 14, enabling a group of documents to be securely gripped without the necessity of punching or stapling. A screw mechanism (not shown in the Figures) is used to apply pressure. A rotatable wing knob 26 (also shown in FIG. 1B) is attached to the screw mechanism, permitting users (not shown in the Figures) to vary the amount of pressure applied by the clamp 18, based upon the direction and amount of rotation imparted to the wing knob 26.

Somewhat understandably, there is a tendency for users to over-tighten the clamp 18 by excessively turning the wing knob 26. At some point a user will want to release the pressure, and because of the over-tightening, find it difficult to accomplish without reliance upon a wrench or other gripping tool.

In an office environment, those types of tools are frequently not readily available. As is depicted in FIG. 1A, an outer grip 32 is depicted as received by the wing knob 26. The outer grip is provided with a plurality of substantially planar elongate gripping surfaces 34. As is shown also in FIG. 1B, one type of wing knob has an elongate axis that is intended to provide the user with greater leverage when operating the screw mechanism by rotating the wing knob 26. The outer grip 32 is further elongated along this same axis, providing even greater leverage to the user.

The wing knob 26 is substantially symmetrical about both its elongate and short axes, as shown in FIG. 2, a single-wing knob 38 is also utilized, but provides symmetry only along the elongate axis. During operation, pressure is applied by the user against a single wing 42 that extends out from the rotational axis—again to provide increased leverage when operating the screw mechanism. A retaining cap nut 44 is used to secure the single wing knob 38 to the screw mechanism. The outer grip 32, including the retaining nut cap 44 that projects above the single wing 42, is designed to be received by the single wing knob 38 as well.

As best shown in FIG. 3, an elongate inner housing 46 having substantially planar inner surfaces is formed within the outer grip 32. A pair of inner frame members 48 are located within the inner housing 44 and project from an inner housing floor 52. Together with the outer walls of the elongate inner housing 46, the inner frame members 48 and the inner housing floor 52 define a centrally located elongate recess 56 of substantially similar configuration to the wing knob 26.

Thus it is the centrally located elongate recess 56 of the outer grip 32 that securely receives the wing knob 26. In the case of the single wing knob 38, the inner frame members 48 are recessed from a bottom surface 62 of the outer grip 32, permitting the retaining nut cap 44 to be received within the centrally located elongate recess 56 and the extending single wing 42 to be received within the elongate inner housing 46.

The outer grip 32 of the present invention is preferably fabricated out of a plastic material. In a presently preferred embodiment, the outer grip 32 has a length of 3 and 9/16 inches, a maximum central width of 1 inch, and a height of ¾ inch. Referring to FIG. 4, the elongate inner housing has a length A of 2½ inches and measures approximately ⅝ inch at the widest, central location. The inner frame members each measure approximately 13/32nds of an inch wide, resulting in the centrally located elongate recess 56 having a length b of approximately 1 3/16 inches. The depth c of the elongate recess is approximately ⅝ inch, with the inner frame members being recessed a distance d of approximately ¼ inch from the bottom surface 62.

My invention has been disclosed in terms of a preferred embodiment thereof, which provides an outer grip handle for vertical plan files and hanging clamps that is of great novelty and utility. Various changes, modifications, and alterations in the teachings of the present invention may be contemplated by those skilled in the art without departing from the intended spirit and scope thereof. It is intended that the present invention encompass such changes and modifications.

What is claimed is:

1. A hand tool to assist in turning a wing knob to adjust clamp pressure in vertical files comprising:

an outer grip having a bottom surface, said bottom surface having an elongate inner housing formed therein, said inner housing having a pair of lattitudinally extending inner frame members, said pair of inner frame members defining a centrally located elongate recess within said elongate inner housing, wherein an inner circumferential surface of said centrally located elongate recess is substantially equivalent to an outer circumferential surface of said wing knob, an outer surface of said outer grip comprises a plurality of substantially planar elongate gripping surfaces, a plurality of substantially planar surfaces are formed within said elongate inner housing and define an inner circumferential surface of said elongate inner housing, and wherein an upper surface of each of said pair of lattitudinally extending inner frame members protrudes from said inner housing floor in a vertical direction.

2. A hand tool according to claim 1, wherein the protruding upper surfaces of said pair of lattitudinally extending inner frame members and said inner circumferential surface of said elongate inner housing define an interior space of dimensions corresponding to a wing knob having a single wing.

* * * * *